US007062866B2

(12) United States Patent
Bussler

(10) Patent No.: US 7,062,866 B2
(45) Date of Patent: Jun. 20, 2006

(54) SHOE HAVING A RELATIVE WIDE TOE BOX COMBINED WITH A FOOTBED TO INHIBIT RELATIVE FORWARD FOOT MOVEMENT

(76) Inventor: Mary L. Bussler, 10809 Lagersfield Cir., Great Falls, VA (US) 22066

( * ) Notice: Subject to any disclaimer, the term of this patent is extended or adjusted under 35 U.S.C. 154(b) by 378 days.

(21) Appl. No.: 10/051,327

(22) Filed: Jan. 22, 2002

(65) Prior Publication Data

US 2004/0168353 A1 Sep. 2, 2004

Related U.S. Application Data

(63) Continuation-in-part of application No. 09/613,770, filed on Jul. 11, 2000, now abandoned.

(60) Provisional application No. 60/143,547, filed on Jul. 13, 1999.

(51) Int. Cl.
*A43B 21/26* (2006.01)
*A61F 5/14* (2006.01)

(52) U.S. Cl. ..... 36/34 R; 36/24.5; 36/102; 36/174; 36/80

(58) Field of Classification Search ..... 36/34 R, 36/38, 24.5, 102, 80
See application file for complete search history.

(56) References Cited

U.S. PATENT DOCUMENTS 2,081,474 A * 5/1937 Burns ..... 36/174
2,408,792 A * 10/1946 Meyer ..... 36/147
4,534,121 A * 8/1985 Autry ..... 36/35 R
D287,302 S * 12/1986 Peterson ..... D2/961
D289,103 S * 4/1987 Autry ..... D2/961
4,955,148 A * 9/1990 Padilla ..... 36/44
5,675,914 A * 10/1997 Cintron ..... 36/3 B

* cited by examiner

*Primary Examiner*—Ted Kavanaugh
(74) *Attorney, Agent, or Firm*—Penrose Lucas Albright

(57) ABSTRACT

A woman's high-heeled pump wherein the heel portion is relatively narrowed and lengthened to extend along and firmly embrace the entire calcaneus of the wearer. The forward portion of the shoe receives the forward part of the wearer's foot including her toes in a relatively unrestrained manner. A foot bed corresponding to the shoe size is received entirely over the shoe's insole and is provided with arch supports that assist in retaining the foot in place within the shoe. The heel is cradled at a level somewhat lower than the surrounding part of the foot bed. The foot bed is provided on its lower side with grooves for comfort and compressability and cavities are provided under the metatarsal pad and heel for compressability and comfort. The upper side of the foot bed has a depression that receives the sesamoid bones and a ridge (toe bar) that extends across the foot bed forward of each of the joints between the metatarsal shafts and the attached distal toe flanges to assist in preventing the foot from moving forward relative to the food bed and shoe. Also forward of the outer tuberosity of the os calcis is a further ridge which interacts with the cuboid bone on the bottom of the heel as a further barrier to prevent the foot from slipping forward in the toe box. Several foot beds may be optionally available for the same shoe size to fit the particular configuration of the wearer's feet.

10 Claims, 2 Drawing Sheets

SHOE HAVING A RELATIVE WIDE TOE BOX COMBINED WITH A FOOTBED TO INHIBIT RELATIVE FORWARD FOOT MOVEMENT

RELATED APPLICATIONS

This Application is a Continuation-in-Part of Application Ser. No. 09/613,770, filed Jul. 11, 2000 now abandoned, which was initially a Provisional Application Ser. No. 60/143,547, filed Jul. 13, 1999.

FIELD OF INVENTION

This invention relates to footwear and, more particularly to a woman's high-heeled pump constructed to avoid the development of malformation of the wearer's feet that cause bunions, tailor's bunions, hammertoes and other foot problems.

BACKGROUND OF THE INVENTION

It is generally known that women's shoes with heel heights of one inch and above cause distortions of the wearer's feet during wear which, in turn, over a period of wear, are the cause of bunions, tailor's bunions, hammertoes and other foot problems. This is largely due to a close fit in the toe box of conventional shoes which have heels of above one inch and the tendency of the feet in their normal wear to be urged into their toe box so that the toe spaces of the shoes constrict the toes of the wearer.

Additionally, the alignment of the last is unnatural according to the alignment of the foot. The arch of the foot is not properly supported; the heel bone, metatarsal heads and toes are also not properly supported; the ball and flesh of the big toe have insufficient room; and usually the big toe is forced towards the second toe.

These problems are also prevalent to some degree in most other footwear. Various solutions have been proposed such as manufacturing shoes made from molds provided by the wearer so that the shoes are conformed to receive the wearer's heel and arch portions snugly while providing more room for the toes in the forward portion of the shoes. An example of such a shoe can be found in U.S. Pat. No. 3,048,240, of Osgood that issued Oct. 15, 1962, which discloses a woman's high-heeled shoe which is provided only with a strap across the toe portion. However, women's footwear which is custom made based on a mold of the foot is expensive, particularly when a number of such footwear are required which are suitable for specific pattern cuts for business and social attire. Accordingly, there is a need for footwear which will not cause deformation of the wearer's feet that leads to bunions, tailor's bunions, hammertoes and other foot problems. The greatest need, however, exists for women's high heeled shoes.

SUMMARY OF THE INVENTION

It has occurred to the inventor that relatively high heeled shoes can be constructed with a number of features which are unique in combination with footbeds received in the shoes which will effectively retain the shoes on the feet of wearer in a manner so that they are unlikely to slip forward and so that the forward portions of the shoe retains the forward part of the foot including the toes in a relatively unrestrained manner, thus avoiding major causes of undesirable foot conditions from developing. As a result, a particular type of footwear is provided which is more comfortable and healthy without unduly sacrificing appearance. The inventor has discovered that although shoes, especially women's, are often too narrow in the forward portion, thus causing foot problems, they are often too wide around the heel and arch area. The inventor has therefore broadened the shoes' toe boxes and, at the same time, sufficiently narrowed and lengthened the heel portions of the shoes. Sufficient girth in the ball portion of the footwear is provided so as not to cause neuromas. Moreover, the heel portion of each shoe and the inside of the counter heel (heel stiffener) are lengthened to extend along and embrace the entire calcaneus, also known as the os calcis or the "heel bone".

An important aspect of the invention relates to a removable footbed which is designed to correspond to the shoe size involved and, in fact, several footbeds may be used with the same shoe size, depending upon the configuration of the wearer's feet.

The footbed in accordance with the invention is received entirely over the shoe's insole and is provided with an arch support which assists in retaining the foot in place in the shoe. The heel is cradled at a level somewhat lower than the surrounding part of the footbed and is supported in the outside by a calcaneus-cubois bar. By this means, the tarsus bone group is supported by positioning the heel bone (calcaneus) into a cup and cradle-shaped space defined by the rear or heel portion of the shoe and the footbed.

The footbed is provided on its lower side with grooves for comfort and compressibility. Additionally cavities are provided under the metatarsal pad and heel and toe bars for compressibility and comfort.

The upper side of the footbed is also provided with a depression which receives the sesamoid bones or, in other words, is disposed under the joint between the first metatarsal shaft and the attached phalange bone of the big toe.

Also provided on the upper side of the footbed is a ridge (toe bar) which extends across the footbed forward of each of the joints between the metatarsal shafts and the attached distal toe phalanges which assists in preventing the foot from moving forward relative to the footbed and shoe.

A further ridge is provided on the upper side of the footbed forward of the outer tuberosity of the os calcis at a position where it interacts with the cuboid bone on the bottom of the heel as a further barrier to prevent the foot from slipping forward in the toe box and to ensure that the heel is securely held in the cavity defined by the heel portion.

Lasts for manufacturing shoes in accordance with the invention are the same as conventional lasts, keeping in mind the relative wide toe box, narrowed heel area and other aspects of the invention as described herein, except that provision is made for receiving the removable footbed within the shoe. The shoe, as such, is manufactured on such a last in a conventional manner from conventional materials. Optionally the shoes may be provided with steel, graphite, plastic or other fiber shanks. The heel counter (stiffener) is form-retentive and extends further on the inside in order to support the arch portions. The removable footbed retains its shape without remaining compressed. The surface of the footbed wicks away moisture.

Several footbeds are provided each shoe size which conform closely, in outline, to the insole area within the shoe.

For each size footbed, two or more different configurations are selectively available, the primary difference being in the portion which corresponds to the arch of the foot. Adequate arch support is important for shoes because it distributes the weight of the foot not only on the ball of the foot, but also on the arch. The footbeds are designed to be removable and can be used interchangeably with different shoes owned by the wearer which have been constructed in accordance with the invention. Optionally they can be secured by adhesive or other means to the insole.

BRIEF DESCRIPTION OF THE DRAWINGS

Other objects, adaptabilities and capabilities of the invention will appear as the description progresses, reference being made to the accompanied drawings, in which.

DETAILED DESCRIPTION OF THE PREFERRED EMBODIMENTS

Figure 1:
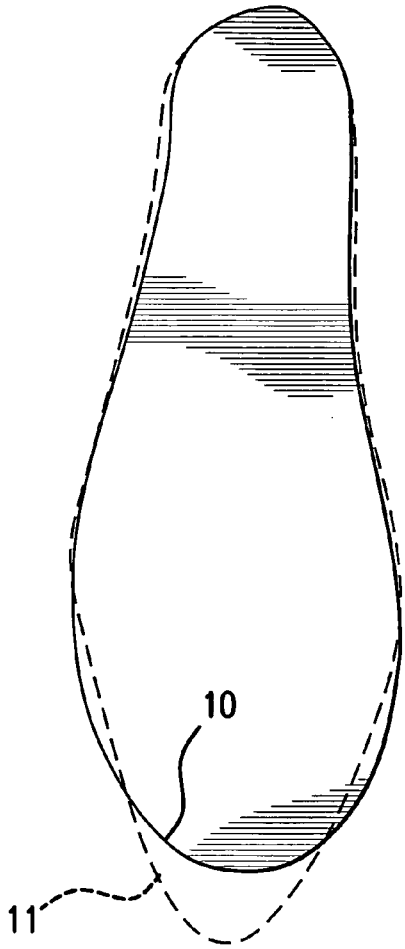
FIG. 1 is a bottom view showing an outline of the innersole of a woman's pump in accordance with the invention in unbroken lines in contrast to a similar outline of a conventional innersole for a woman's pump shown in dashed lines.

In FIG. 1, reference numeral 10 depicts an outline of an innersole as would appear from the bottom inside the shoe of the invention. Dashed lines 11 depict the same outline of an innersole which is conventional for existing shoes, particularly women's shoes. It will be noted that the outline 10 provides more room for the toes of the wearer and thus avoids the podiatric problems caused by conventional women's shoes which, for the same size, are indicated by the dashed lines 11.

Figure 2:
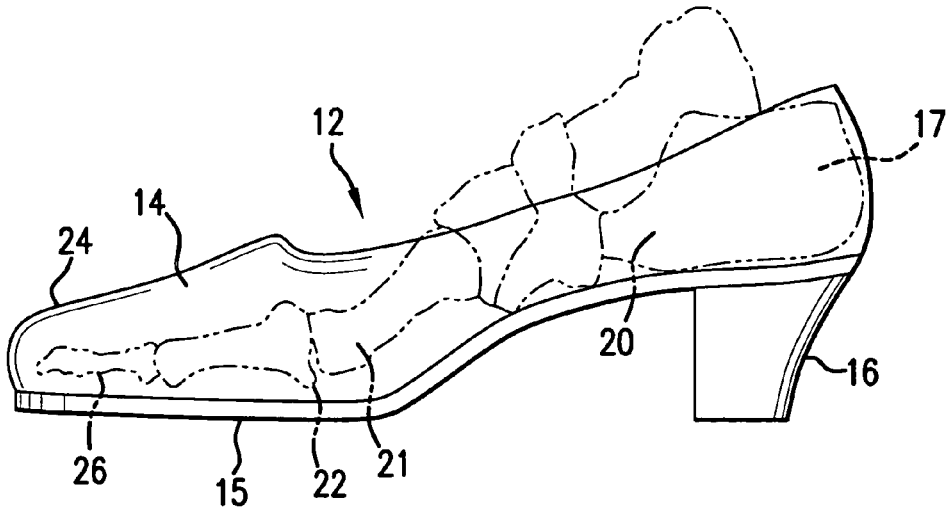
FIG. 2 is a side elevational view of a woman's pump constructed in accordance with the invention illustrating the inside thereof with an outlined skeleton of the foot shown in dashed lines.
Figure 3:
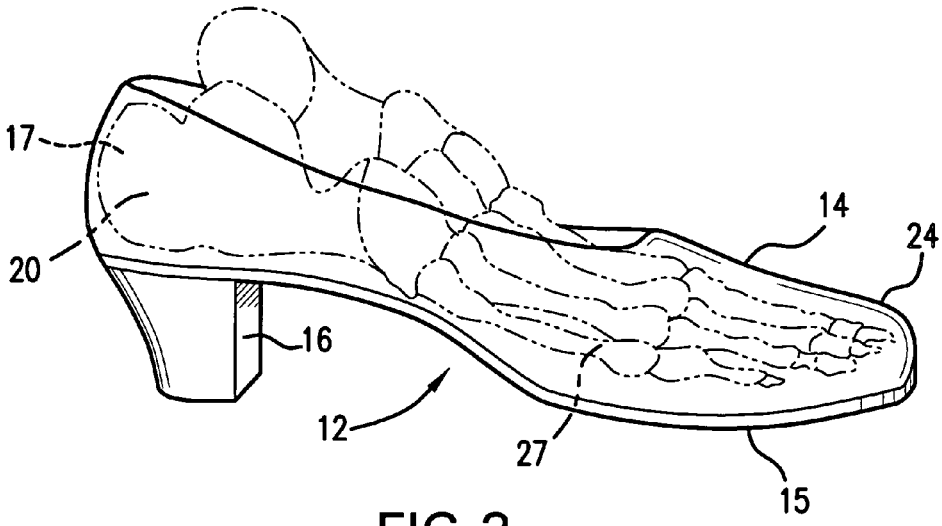
FIG. 3 is a side elevational view similar to FIG. 2 viewed from the outside also having an outlined skeleton of the foot shown in dashed lines.

FIG. 2, is a side view of a woman's pump in accordance with the invention which is indicated generally by reference numeral 12. As in conventional shoes, the shoe comprises an upper 14 and an outer sole 15. The shoe includes a heel 16 which conventionally may be rigidly connected to or part of a shank device (not shown) which functions to stiffen the shoe between the heel and the forward end, heel 16 functioning to elevate the heel of the wearer. Above the heel and the shank (if provided) is a concave recess 17. Because the heel bone or calcaneus of the human foot tapers inwardly, the heel, as such, is widest near its bottom and tapers inwardly slightly in an upward direction so that the cavity 17 for the wearer's heel is such that when a normal foot, within proper size range, is placed in cavity 17, the shoe resiliently clings to the heel. In the instant invention, the stiff part of the shoe which defines cavity 17 is somewhat narrower than conventional (as seen in FIG. 1) and extends farther forward on the inside than is usual to embrace the entire calcaneus (which is indicated by reference numeral 20 in FIGS. 2 and 3) and the arch support area of the footbed.

The articulation of the first metatarsal bone 21 with a proximal phalange or shaft 22, sometimes known as the bunion joint, is disposed at the widest part of the shoe. It is important in the invention that the proximal phalanges and distal phalanges extend naturally forward so that the sides of the upper do not cause constriction—squeezing them together and thus causing deformation. Accordingly, the toe box 24, which includes this portion of the shoe, must be of sufficient width and provide sufficient space to receive the toes of the wearer in their natural disposition without constriction.

Figure 4:
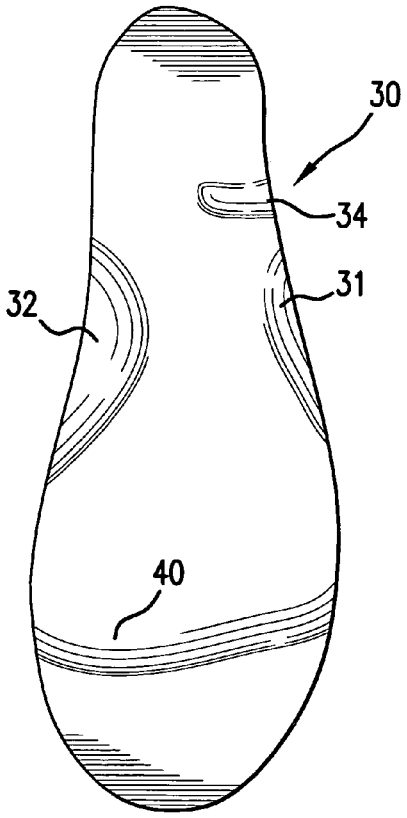
FIG. 4 is a top plan view of a removable footbed in accordance with the invention.
Figure 5:
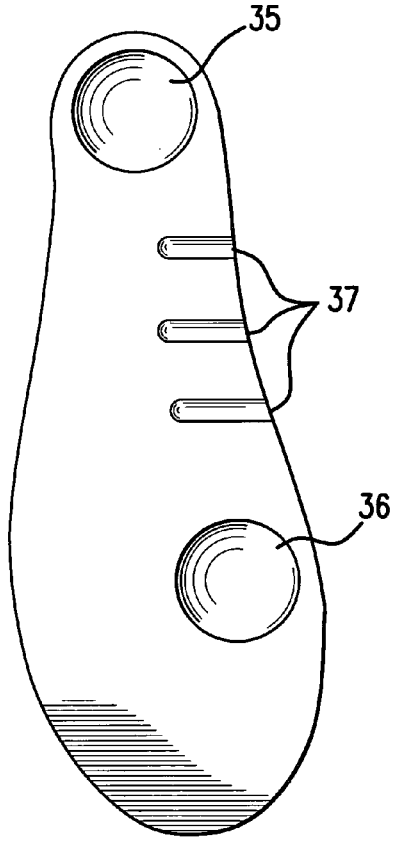
FIG. 5 is a bottom view of the footbed shown in FIG. 4.

The footbed 30 shown top and bottom in FIGS. 4 and 5 comprises an insert for shoe 12 which is conformed to and occupies virtually the entire area of the innersole within the shoe. As previously indicated, the footbeds are preferably removable but can be secured permanently in the shoe. Two longitudinal arches are defined by each foot. One is on the inside extending from the first metatarsal bone 21 to the calcaneus 20 (See FIG. 2). An outer and shorter arch extends from the fifth metatarsal bones 27 to the calcaneus 20 (see FIG. 3). The latter arch carries most of the weight of the body. These arches are accommodated by raised areas 31 and 32 which are contoured to conform to and receive the arches on the bottom of the foot. In addition to providing support for the arches, they assist in retaining the heel of the wearer in the shoe's cavity 17 so that it will not slide forward. A further raised portion 34 is provided at the forward end of the calcaneus 20, which functions to receive weight of the wearer from the calcaneus, the raised portion 34 being disposed under the forward outer portion of the calcaneus. On the bottom of the footbed 30, numerous cavities are provided for heel depression 35. Similar cavities 36 are disposed under the joint between the first metatarsal bone 21 and the adjacent proximal phalange 22, under the toe bar and calcaneus bar which similarly distributes the pressure received at this point over a broader area.

The underside of the footbed 30 includes three grooves 37 which are provided for the purpose of increasing the compressibility of the footbed.

On the upper side of footbed 30 is a ridge 40 which is received forward of the joints between the proximal phalanges and the distal phalanges 26. These function as a further means of retaining the heel of the foot snugly in the heel portion cavity 17 of the shoe 12.

From the foregoing, it will be appreciated that the footbed 30 includes a number of parts which serve to prevent the foot from slipping forward. These include the deep heel cup or cavity 17 wherein the pressure is distributed more equally against the footbed by reason of the depression 35, the calcaneus-cuboid bar or raised portion 34 which also provide cushioning for the heel and together with the deep heel cavity 17 provide support for the calcaneus bone, the metatarsal pad created by depression 36, arch support 32, as well as arch support 31 and ridge 40 under the toe sulcus or toe bar. In addition, the relatively narrower heel which is relatively rigid and extends along the entire calcaneus bone tends to guarantee, in spite of the fact that the shoe has a heel which is higher than one inch, that the foot along the heel and arch portions are so cradled in the shoe that shifting of the foot within the shoe is greatly restricted while at the same time there is ample room in the to toe box of the shoe for the wearer's toes to be disposed in an unconstricted natural manner, not squeezed as currently exists with conventional shoes wherein the heels are one inch high or higher wherein relative forward movement of the foot is inhibited by the snug fit of the toe box applying inward pressure against the metatarsal and proximal and distal phalanges.

Lasts used to manufacture shoes in accordance with the invention are anatomically correct. Each is a straight last with the forepart aligned straight (so that it will not cause bunions or tailor's bunions) and further to ensure that the proximal and distal phalanges are not deviated either to the right or left while providing sufficient lengths and heights to prevent discomfort and pressure against the wearer's toes.

The length and height of the toe box, as discussed above, are sufficient so that it does not cause hammertoes. Sufficient girth in the ball area is provided so that neuromas do not occur. The metatarsal area of the last bottom is enlarged to allow for compressions and insertions of an inserted footbed as a disclosed above which eliminates the pressure points created by current shoe configurations.

The tarsus bone group is supported by positioning the calcaneus bone into a cradle shaped space defined by the footbed and the heel structure of the shoe, thus supporting the entire tarsus group in its natural shape and by raising the heel strike area about one-eighth of an inch. The longitudinal arch formed by the tarsus and metatarsus groups provides extended support of the foot for added comfort. A short calcaneus-cuboid bar to support the outside arch area may be provided to aid in the preventing of the forward foot slide.

Although a primary object of the invention is to provide a shoe for business and social wear, a flat style can, of course, also be provided which has conforming inventive features. Also the invention is useful for higher heeled shoes and boots which are less open than women's pump. In general, various materials may be used in the construction of shoe 12 and footbed 30 as it would occur to one skilled in the art, such as leather, plastic or synthetic material. The stiff portion of shoe 12 which is received around the heel and is somewhat narrower than usual while extending farther forward then usual to embrace the entire calcaneus bone is preferably composed of a thermal material.

Except as indicated above, it is important in particular that the last must be manufactured to accommodate footbeds 30 to be used with shoes 10, the shoes otherwise being manufactured from materials and by techniques known in the art.

Although I have described the preferred embodiment of my invention, it is to be understood that it is capable of other adaptations and modifications within the scope of the appended claims.

Having thus disclosed my invention, what I claim is new and desire to secure by Letters Patent of the United States is:

1. A combination of a shoe having a heel of one or more inches in height and a resilient footbed removably received in the shoe wherein the shoe comprises a forward toe box for receiving the toes of the wearer without pressure being exerted against them by the toe box in normal use of the shoe to dislocate the proximal and distal phalanges of the wearer's foot, the shoe comprising a rear heel portion which grips and holds the wearer's heel firmly in a cradle-like arrangement above the calcaneus bone of the wearer's heel, the footbed having a configuration which conforms to the configuration of a inner sole of the shoe, the footbed comprising a heel cup that distributes the pressure of the wearer's heel against said footbed and contributes to the cradle-like arrangement of said rear heel portion, a calcaneus-cuboid bar underlying the forward part of the wearer's calcaneus bone, the footbed further comprising a metatarsal pad, an arch support and a bar under the wearer's toe sulcus, whereby the wearer's heel is firmly held in place and the foot is prevented from sliding forward in normal usage so that the wearer's toes are not constricted in said forward toe box, and at least one additional cavity disposed under the area of the footbed which receives the wearer's joint between the first metatarsal bone and the adjacent proximal phalange, said additional cavity increasing the compressibility of said footbed at said area.

2. A combination in accordance with claim 1, wherein the footbed further comprises at least one cavity disposed under the portion of the footbed which is received under the wearer's heel that increases the compressibility of the footbed at said portion.

3. A combination in accordance with claim 1, wherein the footbed comprises at least one further cavity disposed at a location under said calcaneus-cuboid bar which distributes the pressure received at said location over a broader area.

4. A combination in accordance with claim 1, wherein the footbed's underside comprises a plurality of grooves extending inboard relative to the wearer's foot which increase the compressibility of the footbed.

5. A combination in accordance with claim 1, wherein said shoe comprises a woman's pump.

6. A combination in accordance with claim 1, wherein said heel of the shoe is between about one and two inches in height.

7. A combination in accordance with claim 1, wherein the height of said heel of the shoe is between about two and three inches.

8. A combination in accordance with claim 1, wherein the height of said heel of the shoe is greater than about three inches.

9. The combination of a shoe having a heel of about one or more inches in height and a resilient footbed in the shoe wherein the shoe comprises a forward toe box for receiving the toes of the wearer without pressure being exerted against them by the toe box in normal use of the shoe to dislocate the proximal and distal phalanges of the wearer's foot, the shoe having an inner sole and the footbed having a configuration which conforms to the configuration of said inner sole, the shoe having a rear heel portion which grips and holds the wearer's heel firmly in a cradle-like arrangement above the calcaneus bone of the wearer's heel that substantially embraces said calcaneus bone, the footbed comprising a heel cup which distributes the pressure of the wearer's heel against the footbed and contributes to the aforesaid cradle-like arrangement, the footbed further comprising a calcaneus-cuboid bar underlying the forward part of said calcaneus bone of the wearer, a metatarsal pad, an arch support and a bar under the wearer's toe sulcus, whereby the wearer's heel is firmly maintained in place and the foot of the wearer is prevented from sliding forward in normal use of the shoe so that the wearer's toes are not constricted in the forward toe box, at least one cavity on the underside of the footbed which receives the wearer's joint between the first metatarsal and the adjacent proximal phalange to increase the compressibility of the footbed in said area, at least one further cavity, and a plurality of grooves extending inboard relative to the wearer's foot in the bottom of the footbed to increase the compressibility of the footbed.

10. A combination in accordance with claim 9, wherein said heel of the shoe has a height of between about one and two inches.

* * * * *